United States Patent [19]

Swain

[11] 4,194,489

[45] * Mar. 25, 1980

[54] COMBINATIONAL FIREPLACE UNIT

[76] Inventor: Samuel J. Swain, 824 Dixie St., Carrollton, Ga. 30117

[ * ] Notice: The portion of the term of this patent subsequent to Dec. 6, 1994, has been disclaimed.

[21] Appl. No.: 852,083

[22] Filed: Nov. 16, 1977

Related U.S. Application Data

[63] Continuation-in-part of Ser. No. 635,422, Nov. 26, 1975, Pat. No. 4,061,133.

[51] Int. Cl.[2] ..... F24D 3/08

[52] U.S. Cl. ..... 126/127; 126/133; 237/8 R; 431/125

[58] Field of Search ..... 126/120, 127, 92 R, 126/133, 5, 350 R, 121; 165/150; 138/38; 431/125; D23/106; 237/8 R

[56] References Cited

U.S. PATENT DOCUMENTS

| | | | |
|---|---|---|---|
| 374,649 | 12/1887 | Backus | 126/133 |
| 563,005 | 6/1896 | Backus | 126/127 |
| 1,786,453 | 12/1930 | Risdon | 126/120 |
| 3,042,109 | 7/1962 | Peterson | 431/125 |
| 3,147,800 | 9/1964 | Tadewald | 165/150 |
| 3,958,755 | 5/1976 | Cleer, Jr. | 237/8 R |
| 4,061,133 | 12/1977 | Swain | 126/133 |

FOREIGN PATENT DOCUMENTS

| | | | |
|---|---|---|---|
| 1328371 | 8/1973 | United Kingdom | 138/38 |

*Primary Examiner*—Larry I. Schwartz
*Attorney, Agent, or Firm*—Cushman, Darby & Cushman

[57] ABSTRACT

A combinational fireplace arrangement has a plurality of log-shaped members having a hollow center portion with a spiral shaped tube passing serially through each of the logs, which tube conveys a fluid through the log-shaped members. A first fuel burning member, within the log member, heats the fluid passing through the spiral shaped tubing. An arrangement of pipes, encased with heat collectors, placed in the fireplace flue, captures energy escaping from the logs and preheats the fluid. A second fuel burning member, controlled independently from the first, is placed beneath the logs to cause the logs to appear to be burning. A thin gauge twisted pair of copper wire within the spiral shaped tube eliminates the formation of air pockets therein.

17 Claims, 2 Drawing Figures

COMBINATIONAL FIREPLACE UNIT

BACKGROUND OF THE INVENTION

This invention is a continuation-in-part of copending application Ser. No. 635,422 filed Nov. 26, 1975 now U.S. Pat. No. 4,061,133 the subject matter of which is incorporated herein by reference thereto.

The present invention relates to apparatus for efficiently heating a room or rooms while at the same time giving the aesthetic appearance of a plurality of logs burning in a fireplace. More specifically, this invention relates to such a heating system with a preheating unit that absorbs a portion of the energy escaping from the primary heating unit, so as to make the system more efficient.

In the past, a number of artificial fireplaces have been developed wherein gas or coal is burned with the flames thereof passing upwardly through and about noncombustible log-shaped members. Examples of such fireplace arrangements are disclosed in the following U.S. Pat. Nos.

258,922 Holland,
464,457 Goetz et al.,
2,671,440 Dupler,
2,796,858 Carpenter,
3,174,475 Tuttle,
3,227,149 Clark,
3,385,651 Rasmussen,
3,747,585 Coats, In addition, fireplaces have been developed wherein water is heated simultaneously while generating a flame, such as disclosed in Backus U.S. Pat. Nos. 374,649 and 563,005 and in Cleer U.S. Pat. No. 3,958,755. A further example of this type of arrangement is disclosed in Mershon U.S. Reissue Pat. No. 5278 wherein a plurality of perforated metal logs are provided having a water pipe positioned on the outside thereof for conducting water therethrough. A source of energy, such as gas, enters the logs and is ignited at the perforations in the logs to heat water passing through a pipe and at the same time to heat the air within a room. This arrangement, however, is not only inefficient but does not provide a pleasant appearance and accordingly, discourages those interested in conserving fuel, i.e., maximizing the efficiency of fuel, from utilizing such a fireplace arrangement.

In another development, Risdon, as disclosed in U.S. Pat. No. 1,786,453, provided a combination fireplace wherein water was passed through preheating coils and then through metal logs wherein the water was heated for utilization in a radiating system. Since the logs were completely filled with water, the transfer of energy to the water was highly inefficient. This arrangement was cumbersome, and not aesthetically appealing.

U.S. Pat. No. 1,131,020 to Wadsworth and 2,541,245 to Halmasy both disclose water heaters wherein water is passed through coils of pipe to absorb energy. Halmasy discloses a burner within a coil of pipe. However, neither of these patents suggest a combinational arrangement for giving the aesthetic appearance of a plurality of logs burning in a fireplace.

Prior art water heaters of the aforementioned type suffer from problems caused by air pockets formed in the fluid. These pockets greatly reduce the efficiency of the pumping and heat transfer process.

It, accordingly, is an object of this invention to provide an improved fireplace arrangement for simultaneously heating a fluid such as water and generating a flame to give the aesthetically pleasing appearance of a conventional fireplace.

It is another object of this invention to more efficiently utilize combustible fuel, in part, by using the energy escaping from the heating process to preheat a heat transfer fluid.

It is still another object of this invention to eliminate the formation of air pockets in the heat transferring fluid which reduces the efficiency of the heat transfer and pumping process.

SHORT STATEMENT OF THE INVENTION

Accordingly, the present invention relates to a combinational fireplace arrangement wherein at least one log-shaped member has a hollow center portion with openings for transferring air from below the log-shaped member to the hollowed center portion. A spiral shaped tube extends substantially throughout the length of each of the logs and each of the tubes are joined together serially for conducting a fluid, such as water, therethrough. A fuel burning means, such as a gas burner, may be passed through the center of the log-shaped members along the longitudinal axis defined by the spiral tubing. The burner generates a flame which is supported by air entering the center portion of the log from below, which flame heats the water passing through the spiral tubing. The exhaust gasses may pass laterally through conduits to an adjacent log where any unburned gasses ignite. At least one log has a plurality of holes in the upper portion thereof to permit the escape of exhaust gasses.

In one embodiment of the invention, arrangment of pipes encased in heat collectors are placed within the flue of the fireplace in order to preheat the fluid using the energy escaping from the logs. The container for the preheater pipes may have a lid which serves as a housing for an exhaust fan to produce a forced draft for the entire system.

Another aspect of this invention is a burner located beneath the logs, controlled separately from the burner within the logs, for creating the appearance that the logs are burning. Still another aspect of this invention is the use of twisted wire within the spiral tubing in order to eliminate the formation of air pockets within the tubing which reduce the efficiency of hot water heating systems.

BRIEF DESCRIPTION OF THE DRAWINGS

Other objects, features and advantages of the present invention will become more fully apparent from the following detailed description of the preferred embodiment of the invention, the appended claims and the accompanying drawings in which:

DETAILED DESCRIPTION OF THE PREFERRED EMBODIMENT

Figure 1:
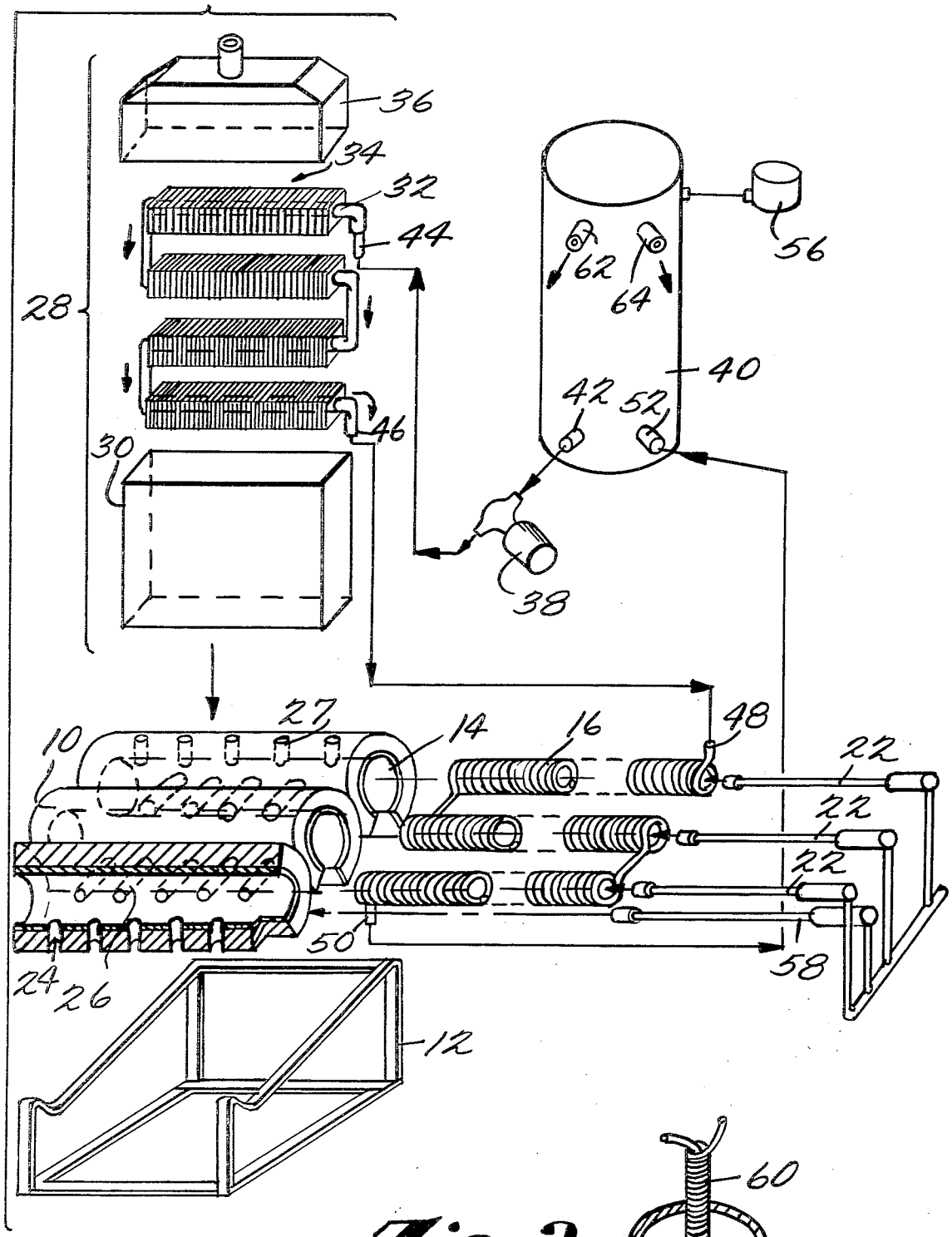
FIG. 1 is an exploded perspective view of the preferred embodiment of the combinational fireplace arrangement of the present invention.

FIG. 1 discloses a preferred embodiment of the present invention. A plurality of log-shaped members such as logs 10 are positioned upon a support grill or frame 12 which may be of any conventional design known in the art. Any suitable noncombustible material may be used to form logs 10, however, in the preferred embodiment logs 10 are made of an asbestos core, around which refractoried clay mixed with fiber binder is poured. The addition of fiber binder to the mix prevents crazing and cracking. Logs 10 are also preferably designed to give the appearance of natural logs.

Each log has a hollow center portion such as center portion 14 for receiving tubing 16 which is formed of a highly heat conductive material such as copper or steel. Tubing 16 is formed in the shape of a spiral through substantially the entire length of the logs 10, which length ranges between 20 inches and 6 feet. The tubing in each log-shaped member 10 is serially connected to a corresponding tubing in the adjacent log 10. Also positioned through the center of hollow portions 14 are burner members 22 which may be of any conventional design, and which can burn, for example, natural gas or a liquid fuel.

Holes such as hole 24 in the bottom of logs 10 permit the entry of air into center portions 14 in order to support combustion. Copper conduits such as conduits 26, which are preferably set approximately 5 inches apart, connect the center portion 14 of each log to the center portions 14 of adjacent logs 10. In this manner gasses remaining unburnt after passing out of the first log entered have further opportunities to be burned. The uppermost of logs 10 has holes such as holee 27 near the top of the log in order to permit the escape of exhaust gasses.

Container 30 of preheater 28 is positioned so as to receive the gasses escaping through holes 27. Container 30 may be composed of any suitable material, but is preferably sheet metal insulated on all sides with the same refactoried clay from which the logs 10 are made. A pipe 32, arranged in a manner, is positioned within container 30. The pipe 32 is encased in heat collectors 34 made of a suitable heat conducting material such as aluminum, copper or plastic. Lid 36 fits snugly over the top of container 30 and serves as a housing for an exhaust fan (not illustrated) that produces a forced draft for the entire system.

Fluid such as water is circulated through the system by pump 38, and the heated fluid is stored in holding tank 40. Expansion tank 56 prevents the possibility of bursting due to the thermal expansion of the fluid. Pump 38 and burners 22 are controlled by thermostats (not shown) located respectively outdoors and on the holding tank 40.

Burner 58 is positioned beneath and runs the full length of the first and second logs 10 so that logs 10 appear to be burning. The fuel for burner 58 is controlled independently of the fuel for burners 22 so that the comfort and beauty of an open burning fireplace can be enjoyed without necessarily causing the fluid to be heated.

Figure 2:
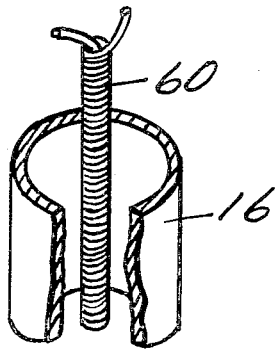
FIG. 2 is a detailed cutaway perspective of a section of the coiled tubing of FIG. 1 showing the twisted wire within the tubing.

FIG. 2 is a cutaway detail of tubing 16. Inserted within tubing 16 is a wire 60, preferably formed of two twisted strands of very fine copper wire. Wire 60 prevents the formation of air pockets which have plagued hot water heating systems in the past. The air within the tubing is finally released at the top of the system by an air vent well known in the art (not shown).

The system will operate only when the outdoor temperature drops below a predetermined temperature, such as 60°. Burners 22 will then ignite and pump 38 will begin to circulate the fluid. The fluid flows from port 42 of holding tank 40 through pump 38 to input port 44 of preheater 28. After the fluid is warmed in preheater 28 by the exhaust gasses escaping from holes 27, the fluid leaves through exit port 46 of preheater 28 and enters port 48 of tubing 16 in which the primary heating takes place. The fluid then leaves port 50 and is returned via port 52 to holding tank 40.

When the water in holding tank reaches a desired temperature, for example 200°, the burner will turn off after which the pump turns off. When the temperature in the holding tank falls below a certain temperature, for example, 150° (while the outside temperature is below 60°), the system turns on again and the cycle repeats itself. Thus preheater 28 takes energy which would ordinarily pass up the chimney and uses it to preheat the fluid, saving an enormous amount of energy that would otherwise be lost.

Port 62 of holding tank 40 connects to the radiating system of the room or rooms, with the water returning to holding tank 40 through port 64. The flow of fluid through the radiator circuit is controlled by a thermostat located within the area to be heated.

Although only one exemplary embodiment of this invention has been described in detail above, those skilled in the art will readily appreciate that many modifications are possible in the exemplary embodiment without materially departing from the novel teachings and advantages of this invention. Accordingly, all such modifications are intended to be included within the scope of this invention as defined in the following claims.

What is claimed is:

1. A combinational fireplace, fluid heating system comprising:

a plurality of log-shaped members having means defining a hollowed center portion and having means for transferring air from below said members to said center portion thereof, at least one of said members having aperture means extending from said center portion to the outside of said member proximate the top thereof;

means for connecting said center portions of adjacent members;

means for supporting said plurality of members;

spiral shaped tubing extending within said hollowed center portion and substantially throughout the length of said plurality of members, for conducting fluid;

first fuel burning means extending along the longitudinal axis defined by said spiral tubing within said plurality of membeers, for heating said fluid passing through said spiral tubing; and means for preheating said fluid using the exhausted energy from said first burning means.

2. Apparatus as in claim 1 wherein: said fireplace includes a flue; and said means for preheating comprises:

means for conveying said fluid, said conveying means passing across said flue a plurality of times, a first end of said conveying means being connected to the supply of said fluid to be heated, and a second end of said conveying means being connected to said heating means, heat collectors encasing said conveying means, and a container enclosing said conveying means having a bottom open toward said heating means and an opening in the top permitting exhaust gasses to escape, said container collecting at least a substantial portion of the gasses escaping from said heating means.

3. Apparatus as in claim 2 wherein said preheating means further comprises an exhaust fan located in said top of said container.

4. Apparatus as in claim 1 further comprising a second fuel burning means located beneath at least one of said plurality of members, and running parallel to and substantially to full length of said member, said second means being controlled independently of said first fuel burning means for causing said member to appear to be burning.

5. Apparatus as in claim 1 further comprising:

a plurality of twisted strands of filaments positioned in and running the length of said spiral shaped tube for the prevention of the formation of air pockets; and an air vent located at the top of said system to permit the escape of air.

6. Apparatus as in claim 5 wherein said plurality of twisted strands of filaments comprises two very thin gauge twisted copper wires.

7. Apparatus as in claim 1 further comprising:

a holding tank connected to said heating and preheating means for storing the heated fluid;

pump means for circulating said fluid between said tank and said preheating and heating means; and control means for activating and deactivating said system upon the occurrence of preselected conditions.

8. Apparatus as in claim 7 wherein said control means includes two thermostats located respectively outdoors and on said holding tank which activate said first fuel burning means and said pump means when both the outdoor temperature drops below a first predetermined value, and the fluid temperature in said holding tank drops below a second predetermined value.

9. Apparatus as in claim 9 further comprising a second fuel burning means located beneath at least one of said plurality of members running parallel to and substantially the full length of said member, said second fuel burning means being controlled independently of said first fuel burning means for causing said member to appear to be burning.

10. Apparatus as in claim 9 further comprising means for preheating said fluid using the exhausted energy from said heating means.

11. Apparatus as in claim 9 wherein:

said log-shaped member further comprises a hollowed center portion, means for transferring air from below said member to said center portion thereof, and said system further comprising a plurality of said log-shaped members, means for connecting said center portions of adjacent log-shaped members, at least one of said log-shaped members having aperture means extending from said center portion to the outside thereof proximate the top thereof;

a spiral shaped tubing extending within said center portion and substantially throughout the length of said at least one member for containing said fluid while said fluid collects energy; and said first fuel burning means extending along the longitudinal axis defined by said spiral tubing within said member.

12. Apparatus as in claim 9 wherein: said fireplace includes a flue; and said preheating means comprises:

means for conveying said fluid, said conveying means passing across said flue a plurality of times, a first end of said conveying means being connected to the supply of said fluid to be heated, and a second end of said conveying means being connected to said heating means, heat collectors encasing said conveying means, and a container enclosing said conveying means, said container having a bottom open toward said heating means and an opening in the top permitting exhaust gasses to escape, said container collecting at least a substantial portion of the gasses escaping from said heating means.

13. Apparatus as in claim 11 further comprising:

a plurality of twisted strands of filaments within and running the length of said spiral shaped tube for the prevention of the formation of air pockets; and an air vent located at the top of said system to permit the escape of air.

14. Apparatus as in claim 13 wherein said plurality of twisted strands of filaments comprises two very thin gauge twisted copper wires.

15. Apparatus as in claim 9 further comprising:

a holding tank connected to said heating and preheating means for storing the said fluid from said heating means;

pump means for circulating said fluid between said tank and said preheating and heating means; and control means for activating and deactivating said system upon the occurrence of preselected conditions.

16. Apparatus as in claim 15 wherein said control means includes two thermostats located respectively outdoors and in said holding tank which activate said first fuel burning means and said pump means when both the outdoor temperature drops below a first predetermined value, and the fluid temperature in said holding tank drops below a second predetermined value.

17. A combinational fireplace, fluid heating system comprising:

at least one log-shaped member in said fireplace;

a first fuel burning means within said at least one member;

means for heating fluid with said first fuel burning means so as to preserve the aesthetic quality of said fireplace;

means connected to said heating means for preheating said fluid using the exhausted energy from said heating means;

a holding tank connected to said heating and preheating means for storing the heating fluid;

pump means for circulating said fluid between said tank and said preheating and heating means; and control means for activating and deactivating said system upon the occurrence of preselected conditions including two thermostats located respectively outdoors and in said holding tank which activate said first fuel burning means and said pumping means when both the outdoor temperature drops below a first predetermined value, and the fluid temperature in said holding tank drops below a second predetermined value.

* * * * *